US005746959A

United States Patent [19]

Cox et al.

[11] Patent Number: 5,746,959

[45] Date of Patent: May 5, 1998

[54] MANUFACTURE OF ACRYLIC FIBER

[75] Inventors: Roland Cox, Derby; Jonathan Michael Taylor, Rugby; Julie Ann Thomson, Coventry, all of United Kingdom

[73] Assignee: Courtaulds Fibres (Holdings) Limited, London, United Kingdom

[21] Appl. No.: 781,357

[22] Filed: Jan. 21, 1997

[30] Foreign Application Priority Data

Jan. 23, 1996 [GB] United Kingdom ..... 9601292

[51] Int. Cl.[6] ..... D01F 1/10; D01F 6/18

[52] U.S. Cl. ..... 264/182; 264/211

[58] Field of Search ..... 264/182, 211

[56] References Cited

U.S. PATENT DOCUMENTS 3,334,126 8/1967 Miyazaki et al. ..... 558/234
4,663,365 5/1987 Reinehr et al. ..... 264/182 X

FOREIGN PATENT DOCUMENTS 456 439 11/1991 European Pat. Off. .
1254702 11/1971 United Kingdom .
2170211 7/1986 United Kingdom .

OTHER PUBLICATIONS

Abstract of Japanese Patent Document No. 05025319 A, dated Feb. 2, 1993.

Search Report on Application GB9701239.7 (Dated Feb. 24, 1997).

Abstract of JP07102475 A (Published Apr. 18, 1995).

Abstract of JP05148710 A (Published Jun. 15, 1993).

Abstract of JP58115116 (Published Jul. 8, 1983).

Abstract of JP58013715 (Published Jan. 26, 1983).

*Primary Examiner*—Leo B. Tentoni
*Attorney, Agent, or Firm*—Howson and Howson

[57] ABSTRACT

Acrylic fiber with persistent antifungal properties can be prepared by extruding a dope which comprises an acrylic polymer in solution and an antifungal agent through a die into a coagulating bath. The antifungal agent is preferably a neutral organic compound of low solubility in water, for example tolnaftate. The antifungal agent is preferably dispersed in the fiber in the form of fine particles.

9 Claims, No Drawings

MANUFACTURE OF ACRYLIC FIBER

FIELD OF THE INVENTION

This invention relates to methods of making acrylic fibers which exhibit antimicrobial, in particular antifungal, activity.

BRIEF SUMMARY OF THE INVENTION

According to the invention there is provided a process for the manufacture of an acrylic fiber comprising the step of extruding through a die into a coagulating bath a dope which comprises (i) an acrylic polymer in solution in a solvent and (ii) a fungicidal agent.

DETAILED DESCRIPTION

The fungicidal agent is preferably a neutral organic compound. In particular, fungicidal agents bearing a permanent positive charge are generally less preferred, because such substances may bind to dye sites in the acrylic polymer, resulting in loss of effectiveness. The fungicidal agent is preferably of low solubility in water, preferably of solubility no more than 1 mg/l at 20° C., whereby it is not readily removed from the fiber by washing. This provides a long-lasting antifungal (antimycotic) effect. Further, the efficiency of incorporation of such an agent into the fiber is high, and the risk of damaging an effluent treatment plant which relies on microbial activity because of release of the agent thereto is low. The melting point of the fungicidal agent is preferably higher than any temperature experienced by the dope or by the fiber during wet processing steps subsequent to extrusion. The melting or sublimation temperature of the fungicidal agent is preferably sufficiently low that it can be caused to migrate through the acrylic fiber by hot treatment processes such as drying or (particularly in the case of textile articles containing the acrylic fiber) ironing. The melting point of the antifungal agent is preferably in the range from 70° to 200° C. The fungicidal agent is preferably tolnaftate, which is a generic name for the compound 2-naphthyl N-methyl-N-(3-tolyl) thionocarbamate (registry no. CAS 2398-96-1), whose manufacture is described in U.S. Pat. No. 3,334,126. Other suitable fungicidal agents include a wide range of azole antimycotics such as bifonazole (CAS 60628-96-8), clotrimazole (CAS 23593-75-1) and agents of the miconazole (CAS 22832-87-7) group; phenolic compounds such as chlorophenes, for example dichlorophene (CAS 97-23-4) and hexachlorophene (CAS 70-30-4); and other known neutral organic fungicidal compounds. Charged or ionisable compounds such as those containing quaternary ammonium groups or undecylenic acid (CAS 112-38-9) are generally less preferred. More than one fungicidal agent may be used if desired.

The acrylic polymer may be any of those known in the art for the manufacture of extruded acrylic articles such as fibers and films. The acrylic polymer comprises at least 85 percent by weight acrylonitrile monomer units. The acrylic polymer often additionally comprises minor amounts of one or more other olefinic monomers, for example neutral monomers such as methyl acrylate or vinyl acetate or ionic monomers such as itaconic acid, methallylsulphonic acid, 2-acrylamido-2-methylpropanesulphonic acid (AMPS), and salts thereof, for example the sodium salts. Such ionic monomers provide dye sites in the fiber.

The dope comprises a solution of the acrylic polymer in a solvent. Many such solvents are known in the art, and they include amides such as dimethyl formamide and aqueous solutions of metal salts such as sodium thiocyanate. The fungicidal agent may be dissolved in the dope, but it is preferably present in particulate dispersion therein. Accordingly, water-based solvent systems (and consequently also water-based coagulating baths) may be preferred. Preferably, the fungicidal agent is dissolved or dispersed in the dope shortly prior to extrusion. It will be understood that particles of the fungicidal agent to be dispersed in the dope should be of small size, for example no more than about 5, preferably no more than about 1, micron in size. Where necessary, particle size may be reduced prior to dispersion in the dope, for example by milling. A mixture of the fungicidal agent and the solvent for the acrylic polymer can be milled to form a dispersion (paste or slurry) containing the agent in particulate form. Such a paste or slurry can be blended with a solution of the acrylic polymer in the solvent to form a dope suitable for use in the process of the invention.

The amount of the fungicidal agent in the fiber may be in the range from 0.001 to 10 percent, often from 0.01 to 2 percent or from 0.1 to 1.0 percent, by weight based on the weight of the acrylic polymer. It will be appreciated that it is often desirable to use the minimum amount of the fungicidal agent that is consistent with effective and long-lasting antifungal properties.

The acrylic fiber may take the form of continuous filament yarn, tow or staple fiber. Extrusion of the dope may be performed in known manner depending on the particular solvent system used. Wet extrusion, as required in the process of the invention, may employ as solvent an aqueous solution of a metal salt such as sodium thiocyanate or zinc chloride or an organic solvent such as dimethylacetamide or dimethylformamide. Inorganic solvent systems may be preferred to minimise any loss of the fungicidal agent into the coagulating bath. The process of the invention can be employed in the manufacture of bicomponent fibers. After extrusion, the acrylic fiber may be further processed and collected in known manner.

The fungicidal agent may be dispersed in the acrylic fiber, at the molecular level or (which may be preferred) as fine particles.

The fungicidal agent may impart further desirable properties to the fiber produced by the invention, for example bactericidal or bacteriostatic properties.

The dope used in the process of the invention may additionally comprise small proportions of one or more other materials known in the art, for example pigments, stabilisers, bactericidal agents and the like. Where a bactericidal agent is used, it may be incorporated into the acrylic fiber by dissolution or dispersion in the dope in similar manner to the fungicidal agent. Such a bactericidal agent may be present in similar amount to the fungicidal agent. One example of a suitable bactericidal agent is 2,4,4'-trichloro-2'-hydroxyphenyl ether.

fiber produced by the process of the invention is useful for the manufacture of antifungal textile articles, including such items as socks, athletic apparel, awnings and tents, both alone and in blend with other types of fiber.

The invention is illustrated by the following Examples, in which parts and proportions are by weight unless otherwise specified:

EXAMPLE 1

10 parts tolnaftate (available from Fermion, a subsidiary of Orion Corporation, or Japan Soda) and 90 parts aqueous sodium thiocyanate (52% solution) were milled for 48 hours or more to reduce the particle size of the tolnaftate (originally 4–90 micron) to a value acceptable for acrylic fiber spinning. The milled paste so formed was blended with an acrylic dope (93% acrylonitrile, 6% methyl acrylate and 1% AMPS; 13% polymer content; viscosity ca. 45 Pa.s; solvent aqueous sodium thiocyanate) by low-shear mixing to provide an injectable premix containing 0.5% tolnaftate. An acrylic dope of the same composition as that used to make the premix was spun through a spinnerette (63 micron holes) into a cold aqueous coagulating bath to form a tow of fiber, which was then washed, finished and dried in conventional manner. The degree of stretch was ×8 and the spinning speed was 32 m/min. fiber decitex was 3.3 or 4. fiber containing 0.1 or 1.0% tolnaftate was prepared by injecting suitable quantities of premix into the dope immediately behind the spinnerette. Samples of fiber were cut to approximately 51 mm staple length and hydroentangled to form nonwoven fabrics which were submitted for microbial testing by a parallel streak test based on AATCC test method 147-1988. Using a 2 mm inoculating loop, a single loopful of diluted microbial culture was transferred to the surface of a suitable agar plate by making five parallel streaks 1 cm apart each 7.5 cm long, the concentration of microorganisms thus decreasing from the first to the fifth streak. Cultures of the bacterium Staphylococcus aureus (approx. $10^8$ cells/ml) and the fungi *Aspergillus niger* and *Trichophyton mentagrophytes* (each approx. $5\times10^7$ cells/ml) were used, the dilution prior to streaking being tenfold in each case. Samples of nonwoven fabric (8 cm×1 cm) were flash sterilised in an autoclave (1.66 bar/115° C./10 sec), moistened with water, and placed transversely across the streaks, pressing gently to ensure firm contact. The plates were then incubated in the inverted position at 37° C./24 hours (*S. aureus*), 25° C./2 days (*A. niger*) or 25° C./7–10 days (*T. mentagrophytes*), after which they were examined and the average width of any zone of inhibition around the samples was measured. The results shown in Table 1 were obtained:

TABLE 1

| Tolnaftate in | Width of Inhibition | | Zone mm (minimum–maximum) | | | |
|---|---|---|---|---|---|---|
| fiber % | *S. aureus* | | *A. niger* | | *T. mentagrophytes* | |
| 0.1 | 0 | 0 | 0 | 9 | 5 | 10 |
| 1.0 | 0 | 0 | 3 | 12 | 6 | 12 |

With *S. aureus*, there was continuous growth in the first (most concentrated) streak and patchy growth in the fifth (least concentrated) streak and no zone of inhibition, indicating some bacteriostatic activity. With *A. niger*, growth was only observed in the two most concentrated streaks under the sample containing 0.1% tolnaftate, indicating fungicidal activity. With *T. mentagrophytes*, no growth was observed in any streak, indicating strong fungicidal activity.

No inhibition was observed with any of the microorganisms when fabric containing no tolnaftate was tested, growth occurring in all streaks.

EXAMPLE 2

Example 1 was repeated, with the following differences. The degree of stretch was ×10, and the fiber decitex was 2.2 or 3.3. The fiber contained 0.3% tolnaftate fiber cut to 51 mm staple length was carded, spun into yarn on the ring system (25 tex, 1/24 cc) and knitted into fabric. Fabrics were also knitted using 70:30 blend yarns of lyocell (solvent-spun rayon available from Courtaulds Fibres (Holdings) Limited under the Trade Mark TENCEL) and the acrylic fiber produced by the method of the invention. Samples of these fabrics were laundered using a conventional domestic washing machine and assessed (in triplicate) for antifungal activity by incubation of *T. mentagrophytes* at 25° C./6 days. The average results (of six results per sample, two per plate) shown in Table 2 were obtained:

TABLE 2

| | Width of Inhibition Zone mm | | | |
|---|---|---|---|---|
| | 100% acrylic | | 70:30 Tencel/acrylic | |
| Launderings | Minimum | Maximum | Minimum | Maximum |
| 1 | 9 | 15 | 9 | 16 |
| 2 | 5 | 16 | 8 | 17 |
| 3 | 6 | 15 | 6 | 17 |
| 4 | 6 | 14 | 8 | 19 |
| 5 | 8 | 13 | 7 | 17 |
| 10 | 9 | 15 | 7 | 17 |
| 15 | 8 | 16 | 6 | 17 |
| 20 | 9 | 19 | 7 | 17 |
| 75 | — | — | 5 | 9 |
| 100 | — | — | 5 | 9 |
| 125 | — | — | 4 | 7 |
| 150 | — | — | 4 | 8 |
| 175 | — | — | 6 | 10 |
| 200 | — | — | 3 | 5 |

A dash in the Table indicates that no measurement was made.

No fungal growth was observed beneath the fabric samples. It will be observed that the antifungal performance of both samples showed excellent persistence through repeated launderings. It will also be observed that the blend fabric gave results at least as good as the 100% acrylic fabric. Control samples (made from conventional acrylic fiber) showed fungal growth in all streaks (zero inhibition zone).

We claim:

1. A process for the manufacture of an acrylic fiber, comprising the steps of:

(a) providing a dope which comprises (i) an acrylic polymer in solution in a solvent, and (ii) a fungicidal agent selected from the group consisting of tolnaftate, bifonazole, clotrimazole, miconazole, dichlorophene and hexachlorophene;

(b) extruding said dope through a die into a coagulating bath: and (c) coagulating said dope in the coagulating bath, thereby forming said acrylic fiber.

2. The process according to claim 1, wherein said solvent comprises water.

3. The process according to claim 2, wherein said solvent is an aqueous solution of sodium thiocyanate.

4. The process according to claim 2, wherein said coagulating bath comprises water.

5. The process according to claim 1, wherein said fungicidal agent is present in said dope in the form of a particulate dispersion.

6. The process according to claim 1, wherein said dope is prepared by a process including the steps of:

(i) milling said fungicidal agent in said solvent to form a particulate dispersion of said fungicidal agent in said solvent;

(ii) providing a solution of said acrylic polymer in said solvent; and (iii) blending said dispersion and said solution to form said dope.

7. The process according to claim 1, wherein the amount of said fungicidal agent imparted to said acrylic fiber in said dope providing, extruding and coagulating steps is in the range of 0.01 to 2 percent by weight based on the weight of the acrylic fiber.

8. The process according to claim 1, wherein said fungicidal agent is tolnaftate.

9. The process according to claim 1, wherein said dope additionally comprises 2,4,4'-trichloro-2'-hydroxyphenyl ether.

* * * * *